United States Patent [19]

Schneider

[11] Patent Number: 4,538,576

[45] Date of Patent: Sep. 3, 1985

[54] DIESEL FUEL INJECTOR WITH DOUBLE DUMP CONFIGURATION

[75] Inventor: Michael J. Schneider, Huntington Woods, Mich.

[73] Assignee: Allied Corporation, Morris Township, N.J.

[21] Appl. No.: 515,747

[22] Filed: Jul. 21, 1983

[51] Int. Cl.[3] ..... F02M 47/02

[52] U.S. Cl. ..... 123/446; 239/88

[58] Field of Search ..... 123/446, 467; 239/88, 239/89, 90, 91, 92

[56] References Cited

U.S. PATENT DOCUMENTS

| | | | |
|---|---|---|---|
| 4,281,792 | 8/1981 | Sisson et al. | 123/502 |
| 4,385,609 | 5/1983 | Kato | 123/446 |
| 4,396,151 | 8/1983 | Kato et al. | 123/446 |
| 4,402,456 | 9/1983 | Schneider | 239/90 |
| 4,418,867 | 12/1983 | Sisson | 239/88 |
| 4,425,894 | 1/1984 | Kato et al. | 123/446 |

*Primary Examiner*—Magdalen Y. C. Moy

*Attorney, Agent, or Firm*—Markell Seitzman

[57] ABSTRACT

A cam driven unit injector for a diesel engine having a single electrically operated control valve for controlling fuel flow to a timing and a metering chamber including a spring cage dumping passage communicated between a spring cage and a return port, this passage housing, in series, a flow restricting orifice and a check valve.

9 Claims, 2 Drawing Figures

Fig-1
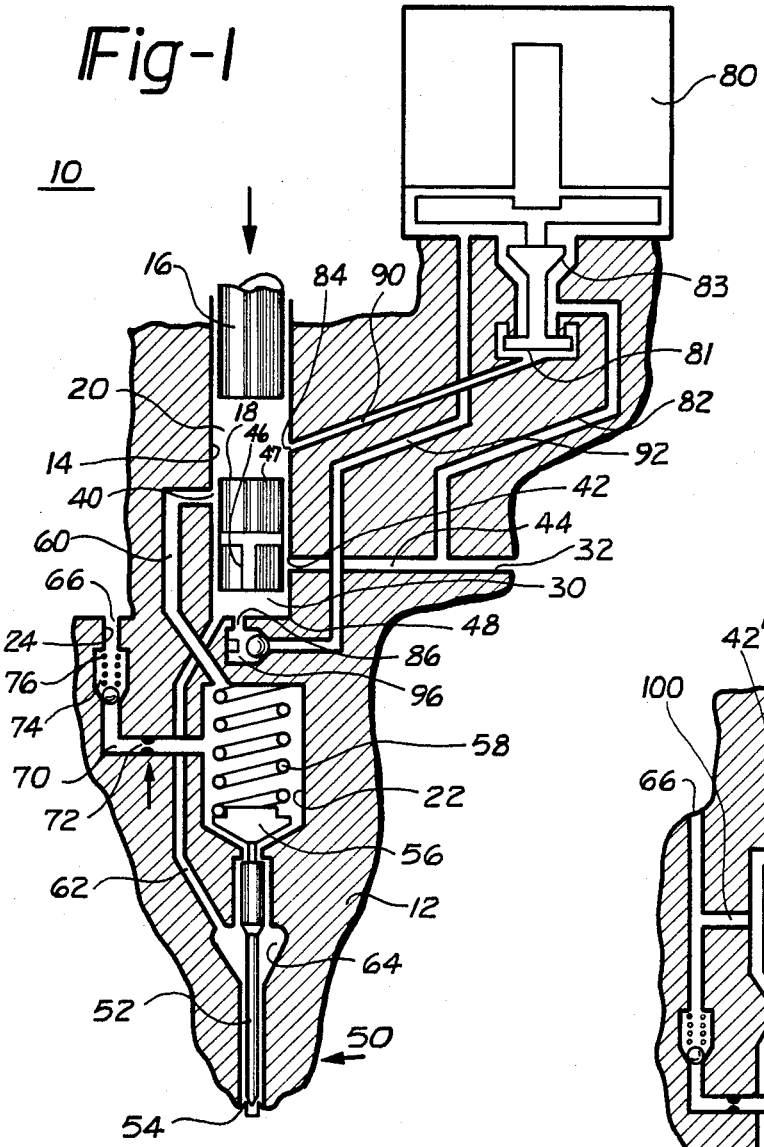
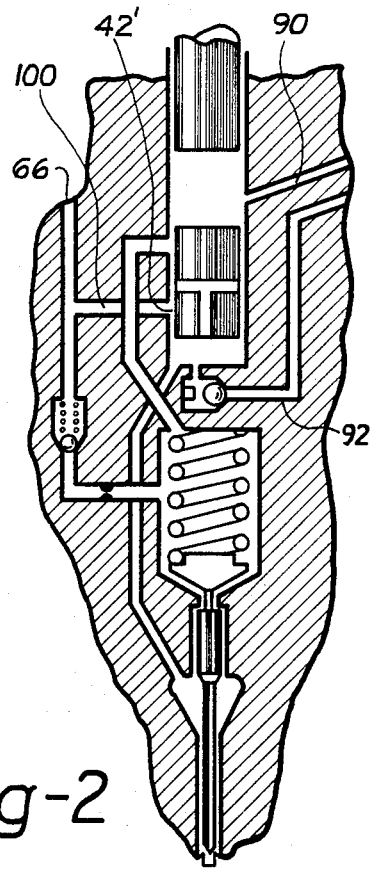
Fig-2

DIESEL FUEL INJECTOR WITH DOUBLE DUMP CONFIGURATION

CROSS REFERENCE TO RELATED APPLICATIONS

This Application is related to the following copending commonly assigned Applications: Ser. No. 364,816 filed Apr. 2, 1982 and now abandoned, Ser. No. 364,813 filed Apr. 2, 1982 and now U.S. Pat. No. 4,418,867 and Ser. No. 364,723 filed Apr. 2, 1982 and now U.S. Pat. No. 4,402,456.

BACKGROUND AND SUMMARY OF THE INVENTION

This invention relates generally to electrically controlled unit injectors and more specifically to the means for venting or dumping the fuel from such an injector having a variable volume timing and metering chamber located therein. A single solenoid unit injector is shown in U.S. Pat. No. 4,281,792 by Sisson et al which illustrates a unit injector capable of independently controlling the timing and metering functions by a single solenoid. A single dump unit injector employing a three-way control valve is described by Sisson in his Application Ser. No. 364,813. In my Patent Application Ser. No. 364,723, I disclose a unit injector having a dump port to relieve the pressure in the timing chamber and another dump port to relieve the pressure in the metering chamber. To enhance the closing of the nozzle portion of the injector, the pressurized fluid in the metering chamber was dumped via a spring cage to a source of fuel via a restricting upstream orifice. While this invention generates enhanced forces to close the nozzle, it does not provide for the unrestricted dumping of fuel from the metering chamber. The Patent Application Ser. No. 364,813 shows a unit injector having a single dumping port which directly relieves the pressure within the timing chamber and indirectly relieves the pressure in the metering chamber. This injector uses a check valve between the metering chamber and the nozzle which is subject to high pressure surges. In contrast, the present invention defines a unit injector having a unique structural configuration wherein the timing chamber dump port is connected to the fuel return of drain via the nozzle spring cage and a flow restricting orifice. In addition the metering chamber is dumped in a relatively unrestricted manner to either the source or to drain. The present invention offers the advantage of enhanced and rapid nozzle closure upon fuel dumping by routing the pressurized timing chamber fuel to the spring cage to force the nozzle closed while permitting unrestricted dumping of the fuel in the metering chamber. The high level of spring cage pressure during and after nozzle closure, combined with the rapid loss of pressure in the metering chamber tends to hold the nozzle closed, thereby reducing or eliminating secondary injections. In addition, the present invention reduces or eliminates the blow back of combustion gases through the injector because of its fast nozzle closure and its tendency to hold the nozzle closed immediately after injection.

Accordingly, the present invention comprises:

A cam driven fuel injector having a fuel inlet port adapted to be connected to a supply or source of fuel and having a drain port; including a body defining a bore having a driven or pumping piston reciprocatively situated therein, a metering or floating piston reciprocatively positioned within said bore remote from the pumping piston; a timing chamber and a metering chamber defined in the bore and metering and timing chamber dump ports located thereon; a spring cage located remote from said cylinder, a spring normally tending to bias a needle valve in a closed position to close off an outflow orifice; a plurality of fuel carrying passages for communicating fuel to the metering and timing chambers and from the timing chamber dump port to the spring cage and needle valve; a single electrically operated control valve for controlling fuel flow to said timing and metering chambers; and a spring cage dumping passage communicated between the spring cage and the return port housing, in series, a flow restricting orifice and a check valve and wherein the metering chamber dump port is communicated directly to the source of fuel.

BRIEF DESCRIPTION OF THE DRAWINGS

In the drawings:

FIG. 1 illustrates a schematic version of a diesel injector.

FIG. 2 illustrates an alternate embodiment of the invention.

DETAILED DESCRIPTION OF THE DRAWINGS

The operation of the present invention can be viewed as having four distinct modes of operation. These are the pre-injection timing phase, the injection phase, the dumping phase and the metering phase. These modes of operation are more specifically defined in the above cited U.S. Patent and Patent Applications, all of which are incorporated herein by reference. Referring now to FIG. 1, there is shown the unit injector 10 having a timing chamber 20 and a metering chamber 30. The timing chamber is dumped through a spring cage 22 to a fuel drain line 24 and the metering chamber 30 is dumped to the fuel inlet 32. The fuel injector includes a body 12 that is adapted to be received within an engine (not shown). The body 12 includes a central bore 14 that is adapted to receive a pumping piston or plunger 16 and a floating piston or plunger 18. The volume of the bore 14 between the pumping piston or plunger 16 and floating piston or plunger 18 defines the timing chamber 20. That portion of the bore 14 below the floating plunger 18 defines the metering chamber 30. FIGS. 1 and 2 illustrate the lower portion of the pumping plunger 16. However, as illustrated in the above incorporated patent, the pumping plunger 16 may be driven by the engine via a rocker arm and cam mechanism (not shown). The bore 14 further includes a timing chamber dump port 40 and a metering chamber dump port 42. The metering chamber dump port 42 is connected via an internal passage 44 to the fuel inlet 32 that is adapted to communicate with a fuel supply. The floating plunger 18 includes means for communicating the metering chamber 30 to the metering chamber dump port 42. This means may include passages 46 in the floating plunger 18 which are moved into alignment with port 42 as a function of the motion of the floating plunger 18. The injector 10 further includes a nozzle 50 located remote from the metering chamber 30. The nozzle 50 includes a needle valve 52 and exit orifice(s) 54 of a known variety. The upper extreme of the needle valve 52 is received within the spring cage 22 and more specifically is received within a seating element 56. The seating element 56 and needle valve 52 are normally biased in a downward position to close the orifices 54 by the operation of a spring 58. A passage 60 connects the timing chamber dump port 40 to the spring cage 22. In addition, another fuel passage 62 communicates the metering chamber 30 to a chamber 64 surrounding the needle valve 52. The spring cage 22 is further communicated to the fuel return line 24 or drain port 66 via a passage 70 which houses, in series, an orifice 72 and check valve 74. The check valve 74 may optionally be spring loaded by the spring 76. The injector 10 further includes a solenoid or control valve 80. The solenoid valve is responsive to electric control signals input thereto. As illustrated in FIG. 1, the solenoid valve is of the three-way variety having a high pressure seat 81 and a low pressure seat 83. However, a two-way control valve such as that utilized in U.S. Pat. No. 4,281,792 may be substituted therefor. The solenoid valve 80 controls the flow of fuel from the fuel supply through passage 82 to the corresponding inlet ports 84 and 86 of the timing and metering chambers, respectively. Fuel flows from the valve 80 through passage 90 to the timing chamber inlet port 84 and through passage 92 to the metering chamber inlet port 86. To enable the metering chamber 30 to be pressurized, a check valve 96 is inserted in the communication between the passage 92 and the metering chamber 30.

Reference is briefly made to FIG. 2 which illustrates an alternate embodiment of the present invention. As shown therein, the fuel passage 44 connecting the fuel supply to the metering chamber dump port 42 has been eliminated. The metering chamber dump port has been repositioned such that it may communicate through a passage 100 to the drain line 66. The metering chamber dump port is generally designated as 42'.

During the pre-injection timing phase of operation, the metering piston 18 is at rest with both dump ports 40 and 42 closed. This condition is illustrated in the accompanying FIGURES. During this phase, the metering chamber 30 is filled with fuel which urges the floating plunger 18 upwardly. The cam driven pumping plunger 16 is thereafter caused to descend into the timing chamber 20 by the action of the rocker arm-cam connection (not shown). Under the control of an electronic control unit (not shown) the control valve 80 permits fuel to be pumped (by operation of the pumping piston 16) back to the supply line through the passages 90 and 82. The injection phase begins when the control valve 80 prohibits fuel communication between passages 90 and 82, thus restricting flow from the timing chamber 20. The fuel within the timing chamber 20 will be compressed as the pumping plunger 16 descends, thus establishing a hydraulic link and forcing the metering piston 18 downward. The downward motion of the metering piston 18 increases the pressure within the metering chamber 30 assisting the check valve 96 to seat to prohibit reverse flow into passage 92 and causing the pressure within nozzle chamber 64 to rise. This increased pressure lifts the needle valve 52 from its seat permitting fuel to be injected through the orifices 54 of the nozzle 50. The dumping of fuel from the respective chambers is begun when the floating piston 18 has been positioned such that its upper edge 47 now exposes the timing chamber dump port 40 to the pressurized fuel within the timing chamber 20 and communicates the metering chamber 30 to the metering chamber dump port 42 through the internal passages 46 within the floating piston 18. The high pressure fuel within the metering chamber 30 is dumped directly to the supply line (FIG. 1) or alternatively, as illustrated in FIG. 2, to drain. The high pressure fuel in the timing chamber 20 flows into the spring cage 22, and then flows through control orifice 72 to the return line. The flow control orifice 72 permits the pressurized fuel of the timing chamber to be dumped more slowly than the fuel within the metering chamber 30 which is dumped in a virtually unobstructed fashion. This differential in flow results in a pressure imbalance which forces the metering piston 18 toward the nozzle 50 until it lodges on the metering piston stop 48 which is formed at the lower extreme of the bore 14. With the metering or floating piston 18 held against the metering piston stop 48, fuel dumps unobstructively from the metering chamber 30 dropping its pressure and allows the combined forces of the spring 58 and enhanced spring cage fuel pressure to cause the needle valve 52 to rapidly close the orifices 54. The pressure of the fuel in the timing chamber and the pressure of the fuel in the spring cage will decay gradually as the pumping plunger 16 approaches its maximum downward stroke and as the rate at which it forces fuel through the flow control orifice 72 slows. As the downward motion of the pumping plunger 16 stops, the metering piston 18 will either remain against its metering piston stop 48 or begin to float towards the timing chamber dump port 40. This will depend upon the relative pressures of the supply and drain lines and the level of spring pre-load on the check valve 74 in the timing chamber dump line 70 and the clearance between the metering piston 18 and the pumping piston 16.

The metering phase of operation begins as the pumping plunger 16 begins to retract or rise. As the pumping plunger 16 begins to retract or rise. As the pumping plunger 16 retracts, fuel is drawn into the metering chamber 30 through the metering check valve 96 and through the metering chamber dump port 42 (while it remains open) therein causing the metering piston 18 to rise. After the metering piston 18 has moved upwardly by a predetermined amount, the dumping ports 40 and 42 are closed. When the desired amount of fuel has been metered into the metering chamber 30, the control valve 80 is switched to prohibit fuel flow into the metering chamber 30 through passage 92 and to connect the timing chamber 20 to the fuel supply which action breaks the hydraulic link between the metering piston 18 and the pumping plunger 16 and thus permits the pumping piston 16 to continue its retraction while not affecting the position of the metering piston 18. The pumping plunger will continue to retract until it is fully withdrawn increasing the volume of the timing chamber permitting additional fuel to flow therein through the control valve 80. During the subsequent pumping stroke of the pumping piston 16, the next pre-injection timing phase of operation is entered with the control valve 80 remaining open as described above to permit fuel to flow from the timing chamber 20.

Many changes and modifications in the above-described embodiments of the invention can, of course, be carried out without departing from the scope thereof. Accordingly, that scope is intended to be limited only by the scope of the appended claims.

Having thus described the invention what is claimed is:

1. A fuel injector for an internal combustion engine comprising:

a body having an axially extending bore;

a primary pumping plunger and a secondary plunger positioned within said body for at least partial axial movement therein;

a nozzle situated at an end of said bore remote from said second plunger;

a timing chamber defined in said body between said primary pumping plunger and said secondary plunger;

a metering chamber defined in said body between said secondary plunger and said nozzle;

first passages in said injector for receiving pressurized fuel and transmitting said fuel into said timing chamber and said metering chamber; and an electromagnetic control element for controlling the timing of the discharge of fuel from the metering chamber through the nozzle and the quantity of fuel stored in said metering chamber subsequent to said discharge of fuel;

fuel dump means for dumping the fuel in the timing and metering chambers as a function of the motion of the secondary plunger including fuel dumping ports located on said bore and uncovered by the motion of said secondary plunger including a timing chamber dump port and a metering chamber dump port;

a spring cage, in communication with said timing chamber dump port and adapted to receive a portion of a needle valve, containing biasing means for urging said needle valve to prohibit the discharge of fuel therefrom;

second passages means for communicating said spring cage to a drain including, in series, an orifice and a check valve; and third passage means for communicating said metering chamber dump port to said drain.

2. The fuel injector as defined in claim 2 wherein said third passage means is connected to said drain and wherein said drain is pressurized.

3. A fuel injector for an internal combustion engine comprising:

a body having an axially extending bore;

a primary pumping plunger and a secondary plunger positioned within said body for at least partial axial movement therein;

a nozzle situated at an end of said bore remote from said second plunger;

a timing chamber defined in said body between said primary pumping plunger and said secondary plunger;

a metering chamber defined in said body between said secondary plunger and said nozzle;

first passages in said injector for receiving pressurized fuel and transmitting said fuel into said timing chamber and said metering chamber;

fuel dump means for dumping the fuel in the timing and metering chambers as a function of the motion of the secondary plunger including fuel dumping ports located on said bore and uncovered by the motion of said secondary plunger including a timing chamber dump port and a metering chamber dump port;

a spring cage, in communication with said timing chamber dump port and adapted to receive a portion of a needle valve, containing biasing means for urging said needle valve to prohibit the discharge of fuel therefrom;

second passages means for communicating said spring cage to a drain including, an orifice; and third passage means for communicating said metering chamber dump port to said drain.

4. The fuel injector as defined in claim 5 further including:

an electromagnetic control element for controlling (1) the timing of the discharge of fuel from the metering chamber through the nozzle and (2) the quantity of fuel stored in said metering chamber subsequent to said discharge of fuel.

5. The fuel injector as defined in claim 4 wherein said second passage means includes a check valve downstream of said orifice.

6. The fuel injector as defined in claim 5 wherein said third passage means is connected to said drain and wherein said drain is pressurized.

7. The fuel injector as defined in claim 7 wherein said third passage means is connected to said drain and wherein said drain is pressurized.

8. In a cam driven fuel injector having a fuel inlet port adapted to be connected to a supply or source of fuel and having a drain port; including a body defining a bore having a driven or pumping piston reciprocatively situated therein, a metering or floating piston reciprocatively positioned within said bore remote from the pumping piston; a timing chamber and a metering chamber defined in the bore and metering and timing chamber dump ports located thereon; a spring cage located remote from said piston, a spring normally tending to bias a needle valve in a closed position to close off an outflow orifice; a plurality of fuel carrying passages for communicating fuel to the metering and timing chambers and from the timing chamber dump port to the spring cage and needle valve; a single electrically operated control valve for controlling fuel flow to said timing and metering chambers; the improvement comprising: a spring cage dumping passage communicated between the spring cage and the drain port, housing in series, a flow restricting orifice and a check valve and wherein the metering chamber dump port is communicated directly to the source of fuel.

9. The fuel injector as defined in claim 8 further including a check valve situated in series with said restricting orifice.

* * * * *